US008899058B2

(12) United States Patent
Unezaki et al.

(10) Patent No.: US 8,899,058 B2
(45) Date of Patent: Dec. 2, 2014

(54) AIR CONDITIONER HEAT PUMP WITH INJECTION CIRCUIT AND AUTOMATIC CONTROL THEREOF

(75) Inventors: Fumitake Unezaki, Tokyo (JP); Makoto Saitou, Tokyo (JP); Tetsuji Saikusa, Tokyo (JP); Masanori Aoki, Tokyo (JP); Masato Yosomiya, Tokyo (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 0 days.

(21) Appl. No.: 11/661,094

(22) PCT Filed: Mar. 27, 2006

(86) PCT No.: PCT/JP2006/306119

§ 371 (c)(1),
(2), (4) Date: Feb. 26, 2007

(87) PCT Pub. No.: WO2007/110908
PCT Pub. Date: Oct. 4, 2007

(65) Prior Publication Data

US 2009/0071177 A1 Mar. 19, 2009

(51) Int. Cl.

| | |
|---|---|
| ***F25B 41/00*** | (2006.01) |
| ***F25B 49/00*** | (2006.01) |
| ***F25B 13/00*** | (2006.01) |
| ***F25B 40/00*** | (2006.01) |
| *F25B 1/10* | (2006.01) |
| *F25B 9/00* | (2006.01) |

(52) U.S. Cl.

CPC ..... *F25B 13/00* (2013.01); *F25B 40/00* (2013.01); *F25B 1/10* (2013.01); *F25B 9/008* (2013.01); *F25B 2309/061* (2013.01); *F25B 2313/02741* (2013.01); *F25B 2400/13* (2013.01); *F25B 2500/31* (2013.01)

USPC ..... 62/197; 62/113; 62/196.1; 62/208; 62/225; 62/513

(58) Field of Classification Search

CPC ..... F25B 13/00; F25B 30/00; F25B 30/02; F25B 49/00; F25B 49/005; F25B 49/022; F25B 2341/065; F25B 2341/0653; F25B 2400/13; F25B 2400/0409

USPC ..... 62/113, 160, 196.1, 197, 205, 225, 62/324.1, 513, 208, 510

See application file for complete search history.

(56) References Cited

U.S. PATENT DOCUMENTS

| | | | | |
|---|---|---|---|---|
| 3,398,785 | A | 8/1968 | Anderson | |
| 3,580,005 | A * | 5/1971 | Hale | 62/149 |

(Continued)

FOREIGN PATENT DOCUMENTS

| | | |
|---|---|---|
| CN | 1379854 | 11/2002 |
| CN | 1468356 | 1/2004 |

(Continued)

OTHER PUBLICATIONS

Supplementary European Search Report in corresponding Application No. 06714603.5-2207 dated Mar. 10, 2009.

(Continued)

*Primary Examiner* — Alexandra Elve
*Assistant Examiner* — Daniel C Comings
(74) *Attorney, Agent, or Firm* — Buchanan Ingersoll & Rooney

(57) ABSTRACT

Heating equipment, including a first heat exchanger, a compressor, a second heat exchanger, and a first expansion valve that decompresses a refrigerant flowing from the second heat exchanger to the first heat exchanger, are connected so as to circulate the refrigerant. A third heat exchanger provides heat of the refrigerant flowing from the second heat exchanger to the first heat exchanger to the refrigerant flowing from the first heat exchanger toward the compressor. An injection circuit merges part of the refrigerant flowing from the second heat exchanger to the first heat exchanger with the refrigerant that is sucked by the compressor. An injection expansion valve is installed in the injection circuit and decompresses the refrigerant flowing in the injection circuit. A fourth heat exchanger is installed in the injection circuit to supply heat of the refrigerant flowing from the second heat exchanger toward the first heat exchanger to the refrigerant flowing in the injection circuit.

20 Claims, 9 Drawing Sheets

(56) References Cited

U.S. PATENT DOCUMENTS

| | | | | | |
|---|---|---|---|---|---|
| 4,364,714 | A | | 12/1982 | Zimmern | |
| 4,411,140 | A | | 10/1983 | Katsummata et al. | |
| 4,644,756 | A | | 2/1987 | Sugimoto et al. | |
| 4,745,767 | A | | 5/1988 | Ohya et al. | |
| 4,760,483 | A | | 7/1988 | Kugelman et al. | |
| 4,885,654 | A | | 12/1989 | Budyko et al. | |
| 5,095,712 | A | | 3/1992 | Narreau | |
| 5,224,354 | A | * | 7/1993 | Ito et al. | 62/196.3 |
| 5,231,845 | A | | 8/1993 | Sumitani et al. | |
| 5,370,307 | A | | 12/1994 | Uehra | |
| 5,634,352 | A | | 6/1997 | Nagai et al. | |
| 5,678,419 | A | * | 10/1997 | Sanada et al. | 62/205 |
| 5,709,090 | A | | 1/1998 | Endo et al. | |
| 5,729,985 | A | | 3/1998 | Yoshihara et al. | |
| 5,737,931 | A | | 4/1998 | Ueno et al. | |
| 5,836,167 | A | | 11/1998 | Clouston et al. | |
| 5,865,038 | A | * | 2/1999 | Maxwell | 62/513 |
| 5,943,879 | A | | 8/1999 | Sada et al. | |
| 6,006,532 | A | | 12/1999 | Suzuki et al. | |
| 6,044,655 | A | | 4/2000 | Ozaki et al. | |
| 6,047,770 | A | | 4/2000 | Suzuki et al. | |
| 6,164,086 | A | | 12/2000 | Kita et al. | |
| 6,237,351 | B1 | | 5/2001 | Itoh et al. | |
| 6,347,528 | B1 | | 2/2002 | Iritani et al. | |
| 6,467,288 | B2 | * | 10/2002 | Kuroki et al. | 62/197 |
| 6,494,055 | B1 | | 12/2002 | Meserole et al. | |
| 6,516,626 | B2 | | 2/2003 | Escobar et al. | |
| 6,581,397 | B1 | * | 6/2003 | Taira et al. | 62/199 |
| 6,718,781 | B2 | * | 4/2004 | Freund et al. | 62/513 |
| 6,931,880 | B2 | | 8/2005 | Aflekt et al. | |
| 7,024,879 | B2 | | 4/2006 | Nakatani et al. | |
| 7,059,151 | B2 | | 6/2006 | Taras et al. | |
| 7,137,270 | B2 | | 11/2006 | Lifson et al. | |
| 7,424,807 | B2 | | 9/2008 | Sienel | |
| 2003/0024267 | A1 | * | 2/2003 | Zhang | 62/513 |
| 2004/0025526 | A1 | * | 2/2004 | Aflekt et al. | 62/513 |
| 2004/0103681 | A1 | | 6/2004 | Aflekt et al. | |
| 2004/0165408 | A1 | | 8/2004 | West et al. | |
| 2006/0164102 | A1 | | 7/2006 | Kramer et al. | |

FOREIGN PATENT DOCUMENTS

| | | | | | |
|---|---|---|---|---|---|
| DE | 2 252 434 | | | 5/1974 | |
| EP | 0 299 069 | | | 1/1989 | |
| EP | 0778451 | A2 | | 6/1997 | |
| EP | 0 837 291 | A2 | | 4/1998 | |
| JP | 56-144364 | | | 11/1981 | |
| JP | 57-21760 | A | | 2/1982 | |
| JP | 57-118255 | | | 7/1982 | |
| JP | 63-127056 | A | | 5/1988 | |
| JP | 64-90961 | | | 4/1989 | |
| JP | 01-239350 | | | 9/1989 | |
| JP | 03-105160 | | | 5/1991 | |
| JP | 03-294750 | | | 12/1991 | |
| JP | 4-18260 | U | | 2/1992 | |
| JP | 08-210709 | A | | 8/1996 | |
| JP | 09-159287 | | | 6/1997 | |
| JP | 10-089780 | A | | 4/1998 | |
| JP | 10-115470 | A | | 5/1998 | |
| JP | 10-160269 | | | 6/1998 | |
| JP | 10-332212 | | | 12/1998 | |
| JP | 11-157327 | A | | 6/1999 | |
| JP | 11-248264 | | | 9/1999 | |
| JP | 11-248267 | | | 9/1999 | |
| JP | 2000-074504 | | | 3/2000 | |
| JP | 2000-234811 | A | | 8/2000 | |
| JP | 2000-249413 | | | 9/2000 | |
| JP | 2000-274859 | A | | 10/2000 | |
| JP | 2000-304374 | A | | 11/2000 | |
| JP | 2001-012786 | A | | 1/2001 | |
| JP | 2001-27460 | | | 1/2001 | |
| JP | 2001-174091 | A | | 6/2001 | |
| JP | 2001227823 | A | | 8/2001 | |
| JP | 2001-263882 | | | 9/2001 | |
| JP | 2001-296058 | A | | 10/2001 | |
| JP | 2001-296067 | | | 10/2001 | |
| JP | 2001-304714 | A | | 10/2001 | |
| JP | 2001-324237 | A | | 11/2001 | |
| JP | 2001349623 | A | | 12/2001 | |
| JP | 2002-005536 | | | 1/2002 | |
| JP | 2002-81767 | | | 3/2002 | |
| JP | 2002-120546 | | | 4/2002 | |
| JP | 2002-162086 | A | | 6/2002 | |
| JP | 2002-228275 | | | 8/2002 | |
| JP | 2003-065615 | A | | 3/2003 | |
| JP | 2003106693 | A | * | 4/2003 | F25B 5/02 |
| JP | 2003-185286 | | | 7/2003 | |
| JP | 2003-194432 | A | | 7/2003 | |
| JP | 2004-028485 | | | 1/2004 | |
| JP | 2004-100608 | | | 4/2004 | |
| JP | 2004-108687 | | | 4/2004 | |
| JP | 2004-183913 | | | 7/2004 | |
| JP | 2004189913 | A | | 7/2004 | |
| JP | 2004-218964 | | | 8/2004 | |
| JP | 2005-214550 | | | 8/2005 | |
| JP | 2006-112708 | A | | 4/2006 | |
| JP | 2009-178122 | A | | 8/2009 | |
| WO | WO 02/18848 | | | 3/2002 | |
| WO | WO 2004/010557 | | | 1/2004 | |

OTHER PUBLICATIONS

Notification of Reasons for Refusal from the Japanese Patent Office dated Feb. 19, 2010 in Japanese Patent Application No. 2009-178122, and an English-language translation thereof.

Notification of Reasons for Refusal from the Japanese Patent Office dated Feb. 19, 2010 in Japanese Patent Application No. 2009-178206, and an English-language translation thereof.

Japanese release announcement for "Zubadan-Slim", Mitsubishi Electric Corporation, Apr. 14, 2005, 9 pages, and English-language translation thereof.

Notification of Rejection from the JPO, Jun. 27, 2006.

Decision of Refusal from the JPO with English translation thereof, Mar. 6, 2007.

Inquiry from the JPO with English translation thereof, Mar. 17, 2009.

Written Reply with English translation thereof, May 13, 2009.

Notification of Rejection from the JPO with English translation thereof, Jun. 30, 2009.

Written Argument and English translation thereof, Jul. 30, 2009.

Notification of Rejection from the JPO with English translation thereof, Jun. 23, 2009.

Written Argument with English translation thereof, Aug. 21, 2009.

Communication Pursuant to Article 94(3) EPC dated Mar. 6, 2008.

Summons to attend oral proceedings pursuant to Rule 115(1) EPC, Jan. 1, 2009.

1996 ASHRAE Handbook, "Heating, Ventilating, and Air-Conditioning Systems and Equipment", SI Edition, American Society of Heating, Refrigerating and Air-Conditioning Engineers, Inc., Atlanta, GA, pp. 34.11-34.14 and 34.20.

Notification of Rejection from the JPO, Oct. 27, 2009.

Japanese language Information Statements submitted in corresponding Japanese Patent Application No. 2009-178122 and Japanese Patent Application No. 2009-178206 on Apr. 5, 2010.

Notification of Reasons for Refusal issued Apr. 8, 2011 in corresponding application JP 2009-178280, and a computer-generated English translation thereof.

Office Communication from European Patent Office issued in Applicant's corresponding European Patent Application No. 06730067.3 dated Nov. 16, 2010.

Office Action issued on May 11, 2011 in corresponding Chinese Patent Application No. 200910169183.9.

Office Action dated Aug. 17, 2011, issued in the Corresponding Chinese Patent Application No. 200910169182.4, and an English Translation of the main body thereof.

Office Action dated May 11, 2011, issued in the corresponding Chinese Patent Application No. 200910169184.3, and an English Translation thereof.

(56) References Cited

OTHER PUBLICATIONS

An English Translation of the Office Action dated May 11, 2011, issued in the corresponding Chinese Patent Application No. 200910169183.9.
Notification of Reasons for Refusal dated Dec. 16, 2011 issued by the Chinese Patent Office in corresponding Chinese Patent Application No. 200910169183.9, and an English translation of the main body thereof.
Notification of Reasons for Refusal dated Dec. 31, 2011 issued by the Chinese Patent Office in corresponding Chinese Patent Application No. 200910169184.3, and an English translation of the main body thereof.
Decision of Final Rejection dated Jan. 10, 2012 issued by the Japanese Patent Office in corresponding Japanese Patent Application No. 2009-178280, and an English translation thereof.
European Search Report issued in EP 10004942,8 dated Apr. 23, 2012.
Notification for Reasons of Refusal issued in JP 2010-096148 dated Mar. 27, 2012.
First Office Action issued May 25, 2012 by the Chinese Patent Office in corresponding Chinese Patent Application No. 200910169182.4, and an English translation of the main text.
First Office Action issued May 25, 2012 by the Japanese Patent Office in corresponding Japanese Patent Application No. 200910169182.4, and an English translation of the main text.
Office Action dated Jan. 27, 2011 issued by the USPTO in corresponding U.S. Appl. No. 12/654,827.
Office Action dated Jun. 6, 2012 issued by the USPTO in corresponding U.S. Appl. No. 12/654,827.
Office Action dated May 26, 2011 issued by the USPTO in corresponding U.S. Appl. No. 12/760,190.
Office Action dated Feb. 3, 2012 issued by the USPTO in corresponding U.S. Appl. No. 12/760,190.
Office Action dated Jan. 28, 2011 issued by the USPTO in corresponding U.S. Appl. No. 12/654,828.
Office Action dated Jun. 30, 2011 issued by the USPTO in corresponding U.S. Appl. No. 12/654,828.
Office Action dated Dec. 7, 2011 issued by the USPTO in corresponding U.S. Appl. No. 12/654,828.
Notice of Reasons for Rejection issued on Oct. 9, 2012 by the Japanese Patent Office in corresponding Japanese Application No. 2011-127682, and an English translation thereof.
Japanese Office Action dated Sep. 17, 2013, issued by the Japanese Patent Office in corresponding Japanese Patent Application No. 2011-127682, and English language translation of Office Action. (4 pages).
Notice of Reasons for Rejection issued Jun. 4, 2013 by the Japanese Patent Office in corresponding Japanese Application No. 2011-127682, and an English translation thereof.
Office Action dated May 23, 2013 issued by the European Patent Office in corresponding European Patent Application No. 06 730 067.3.
Japanese Office Action (Notice of Reasons for Refusal) dated Jun. 3, 2014, issued in corresponding Japanese Patent Application No. and an English translation thereof. (7 pgs).

* cited by examiner

AIR CONDITIONER HEAT PUMP WITH INJECTION CIRCUIT AND AUTOMATIC CONTROL THEREOF

TECHNICAL FIELD

The present invention relates to refrigerant air conditioners, and in particular relates to a refrigerant air conditioner capable of improving its heating capacity by gas injection during a low outdoor temperature.

BACKGROUND ART

As conventional refrigerant air conditioners, there has been an air conditioner in that refrigerant gas separated in a gas liquid separator arranged in an intermediate pressure portion between a condenser and an evaporator is injected into an intermediate pressure portion of a compressor so as to increase a heating capacity (see Patent Document 1, for example). Also, there is an air conditioner in that instead of providing the gas liquid separator, part of high-pressure refrigerant liquid is bypassed and reduced in pressure, which in tern is injected into a compressor after it is evaporated by exchanging heat with that of high-pressure refrigerant liquid so as to increase a heating capacity (see Patent Document 2, for example).

Also, there is an air conditioner in that a liquid receiver is provided in an intermediate pressure portion between a condenser and an evaporator, so that heat of the refrigerant in the liquid receiver is exchanged with heat of the refrigerant sucked by a compressor (see Patent Document 3, for example).

Patent Document 1: Japanese Unexamined Patent Application Publication No. 2001-304714

Patent Document 2: Japanese Unexamined Patent Application Publication No. 2000-274859

Patent Document 3: Japanese Unexamined Patent Application Publication No. 2001-174091

DISCLOSURE OF INVENTION

Problems to be Solved by the Invention

However, the following problems have arisen in the conventional refrigerant air conditioners. First, as in the conventional example in Patent Document 1, during injection from the gas liquid separator, the liquid amount in the gas liquid separator is changed in accordance with the injection amount, so that there has been an unstable operation problem caused by the change in refrigerant liquid amount distribution in a refrigerating cycle.

When the injected refrigerant gas is balanced in flow rate with the refrigerant gas in two-phase refrigerant flowing into the gas liquid separator, the refrigerant liquid amount in the gas liquid separator is stabilized because only the refrigerant liquid flows out toward the evaporator. However, if the flow rate of the injected refrigerant decreases to less than that of the refrigerant gas flowing into the gas liquid separator, the refrigerant gas also flows out toward the evaporator so that gas flows out from the bottom of the gas liquid separator and almost all the liquid in the gas liquid separator flows out.

In reverse, when the flow rate of the injected refrigerant increases, the refrigerant liquid is also injected among the refrigerant gas because of the shortage of the refrigerant gas. Consequently, the liquid flows out from the top of the gas liquid separator so as to fill the gas liquid separator almost with the liquid.

Since the injection flow rate is liable to change according to high-low pressures in a refrigerating cycle, the pressure in the gas liquid separator, and the operation capacity of the compressor, the injected refrigerant gas is scarcely balanced in flow rate with the refrigerant gas flowing into the gas liquid separator. In practice, the refrigerant liquid amount in the gas liquid separator is whether almost zero or in a flooded state, and the refrigerant amount in the gas liquid separator is liable to change according to operation situations. Consequently, the refrigerant liquid amount distribution in a refrigerating cycle is liable to change so that the operation fluctuates.

Such operation instability following the change in the refrigerant amount in the gas liquid separator is solved by bypassing and injecting part of the high-pressure refrigerant liquid like in the conventional example in Patent Document 2, because of the absence of a liquid reservoir portion. However, even in this structure, the following problems remain.

In general, the refrigerating cycle with the gas injection can increase the heating capacity in accordance with the increase in refrigerant flow rate flowing into a room heat exchanger from the compressor by increasing the injection flow.

However, if the injection flow rate is increased, the refrigerant liquid is also injected among the refrigerant gas so that the room heat exchanger is decreased in heat exchanging capacity by decreasing the discharge temperature of the compressor so as to also reduce the refrigerant temperature at the inlet of the room heat exchanger. Hence, an injection flow rate exists in that the heating capacity is maximized by keeping the balance between the refrigerant flow rate and the heat exchanging capacity.

In general refrigerant air conditioners of air heat-source heat pump type, in cold districts with atmospheric temperatures of −10° C. or less, the sufficient heating operation cannot be performed because of the reduction in heating capacity, so that apparatuses capable of displaying the more sufficient heating capacity have been demanded. However, the gas injection cycle described above has a limit of the heating capacity so that the sufficient heating operation cannot be performed.

The conventional example described in Patent Document 3 also has no heating capacity increasing configuration in its circuit structure, so that in the same way, the heating capacity is reduced and the sufficient heating operation cannot be performed in the cold districts.

In view of the problems described above, it is an object of the present invention to provide a refrigerant air conditioner capable of displaying a sufficient heating capacity even in cold districts with atmospheric temperatures of −10° C. or less by improving the heating capacity in the refrigeration air conditioner more than that of conventional gas injection cycles.

Means for Solving the Problems

A refrigerant air conditioner according to the present invention including a compressor, a room heat exchanger, a first pressure reducing device, and an outdoor heat exchanger, which are circularly connected, for supplying hot heat from the room heat exchanger, further includes a first internal heat exchanger for exchanging heat of refrigerant existing between the room heat exchanger and the first pressure reducing device with heat of refrigerant existing between the outdoor heat exchanger and the compressor; an injection circuit for bypassing part of the refrigerant existing between the room heat exchanger and the first pressure reducing device so as to inject it into a compression chamber within the compressor; a pressure reducing device for injection provided along the injection circuit; and a second internal heat exchanger for exchanging heat of refrigerant reduced in pressure by the pressure reducing device for injection with heat of the refrigerant existing between the room heat exchanger and the first pressure reducing device.

EFFECT OF THE INVENTION

As described above, according to the present invention, when heating operation to supply hot heat from the room heat exchanger is performed in the system of circularly connected the compressor, the room heat exchanger, the first pressure reducing device, and the outdoor heat exchanger, refrigerant sucked into the compressor is heated by the first internal heat exchanger to exchange heat of refrigerant existing between the room heat exchanger and the first pressure reducing device with heat of refrigerant existing between the outdoor heat exchanger and the compressor. Thereby, even if the flow rate of the refrigerant injected in the compression chamber in the compressor is increased by bypassing part of refrigerant existing between the room heat exchanger and the first pressure reducing device, the reduction in discharge temperature of the compressor is suppressed, so that the sufficient heating capacity can be secured by making the room heat exchanger display the sufficient heat exchanging capacity even in conditions liable to reduce the heating capacity such as cold ambient temperature. Simultaneously, when supplying the refrigerant for gas injection by the second internal heat exchanger for exchanging heat of refrigerant reduced in pressure by the pressure reducing device for injection with heat of refrigerant existing between the room heat exchanger and the first pressure reducing device, the change in liquid amount due to use of the gas liquid separator can be avoided by supplying the bypassed and gasified refrigerant without a gas liquid separator, achieving much more stable operation of the apparatus.

REFERENCE NUMERALS

1: outdoor unit, 2: room unit, 3: compressor, 4: four-way valve, 5: gas pipe, 6: room heat exchanger, 7: liquid pipe, 8: second expansion valve, 9: first internal heat exchanger, 10: second internal heat exchanger, 11: first expansion valve, 12: outdoor heat exchanger, 13: injection circuit, 14: third expansion valve for injection, 15: measurement control unit.

Best Mode for Carrying Out the Invention

First Embodiment

Figure 1:
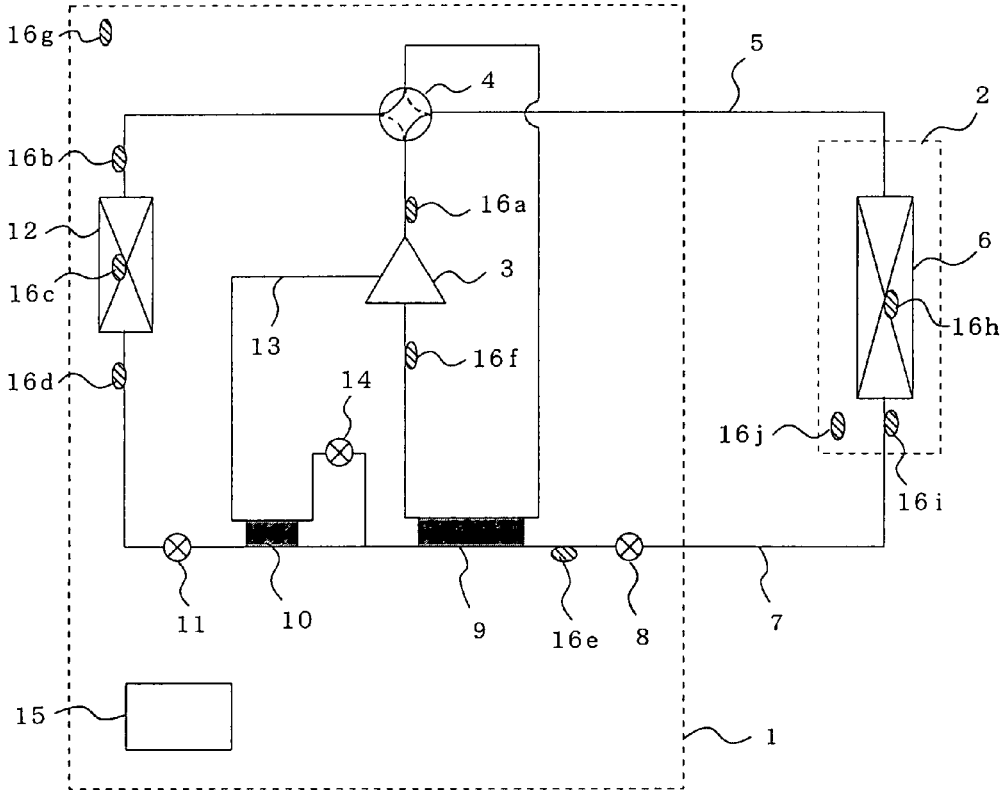
FIG. 1 is a refrigerant circuit diagram of a refrigerant air conditioner according to a first embodiment of the present invention.

FIG. 1 is a refrigerant circuit diagram of a refrigerant air conditioner according to a first embodiment of the present invention.

In FIG. 1, on an outdoor unit 1, there are mounted a compressor 3, a four-way valve 4 for switching the operation between heating and cooling, an outdoor heat exchanger 12, a first expansion valve 11, which is a pressure-reducing device, a second internal heat exchanger 10, a first internal heat exchanger 9, a second expansion valve 8, which is a pressure-reducing device, an injection circuit 13, and a third expansion valve 14, which is a pressure-reducing device for injection.

The compressor 3 is a type of compressor controlled in capacity by controlling the number of revolutions with an inverter, and is capable of injecting refrigerant supplied from the injection circuit 13 into a compressing chamber of the compressor 3.

The first expansion valve 11, the second expansion valve 8, and the third expansion valve 14 are electronic expansion valves controlled to be variable in opening. The outdoor heat exchanger 12 is for heat-exchanging with outside air blown by a fan and the like.

Within a room unit 2, a room heat exchanger 6 is mounted. A gas pipe 5 and a liquid pipe 7 are connection pipes for connecting between the outdoor unit 1 and the room unit 2. For the refrigerant of this refrigerant air conditioner, R410A is used which is a mixed HFC refrigerant.

Within the outdoor unit 1, a measurement control unit 15 and temperature sensors 16 are arranged. A temperature sensor 16*a* is arranged on discharge side of the compressor 3; a temperature sensor 16*b* between the outdoor heat exchanger 12 and the four-way valve 4; a temperature sensor 16*c* along a refrigerant flow path in the intermediate portion of the outdoor heat exchanger 12; a temperature sensor 16*d* between the outdoor heat exchanger 12 and the first expansion valve 11; a temperature sensor 16*e* between the first internal heat exchanger 9 and the second expansion valve 8; and a temperature sensor 16*f* on suction side of the compressor 3, for measuring the refrigerant temperature at the respective installation sites. Also, a temperature sensor 16*g* is for measuring the outside air temperature around the outdoor unit 1.

Within the room unit 2, temperature sensors 16*h*, 16*i*, and 16*j* are arranged: the temperature sensor 16*h* is arranged along a refrigerant flow path in the intermediate portion of the room heat exchanger 6 and the temperature sensor 16*i* is arranged between the room heat exchanger 6 and the liquid pipe 7, for measuring the refrigerant temperature at the respective installation sites; and the temperature sensor 16*j* is for measuring the temperature of air to be sucked into the room heat exchanger 6. When a heat medium as a load is other media, such as water, the temperature sensor 16*j* is for measuring the temperature of the flowing-in medium.

The temperature sensors 16*c* and 16*h* can detect saturated temperatures of the refrigerant at high-low pressures, respectively, by detecting the temperatures of the refrigerant in a gas-liquid two-phase state in the respective intermediate portions of the heat exchangers.

The measurement control unit 15 within the outdoor unit 1 controls the operation method of the compressor 3, the flow-path switching of the four-way valve 4, the blowing air volume of the fan, and the openings of the respective expansion valves, on the basis of the information measured by the sensors 16 and operation instructions from a user of the refrigerant air conditioner.

Then, the operation in the refrigerant air conditioner will be described.

First, the operation during heating will be described with reference to PH diagrams during heating operation shown in FIGS. 1 and 2.

During the heating operation, the flow path of the four-way valve 4 is established in directions shown by solid lines of FIG. 1. The high temperature and pressure refrigerant gas (the point 1 in FIG. 2) discharged from the compressor 3 flows out of the outdoor unit 1 via the four-way valve 4 so as to flow in the room unit 2 via the gas pipe 5. Then, the gas flows in the room heat exchanger 6 so as to be condensed and liquefied while radiating heat in the room heat exchanger 6 as a condenser, becoming the high pressure and low temperature refrigerant liquid (the point 2 in FIG. 2). The heat radiated from the refrigerant is given to load-side media, such as air and water, so as to perform heating operation.

The high pressure and low temperature refrigerant flowing out of the room heat exchanger 6 flows in the outdoor unit 1 via the liquid pipe 7. Thereafter, it is slightly reduced in pressure (the point 3 in FIG. 2) in the second expansion valve 8, and then, it gives heat to the low temperature refrigerant to be sucked to the compressor 3 in the first internal heat exchanger 9 so as to be cooled (the point 4 in FIG. 2).

Figure 2:
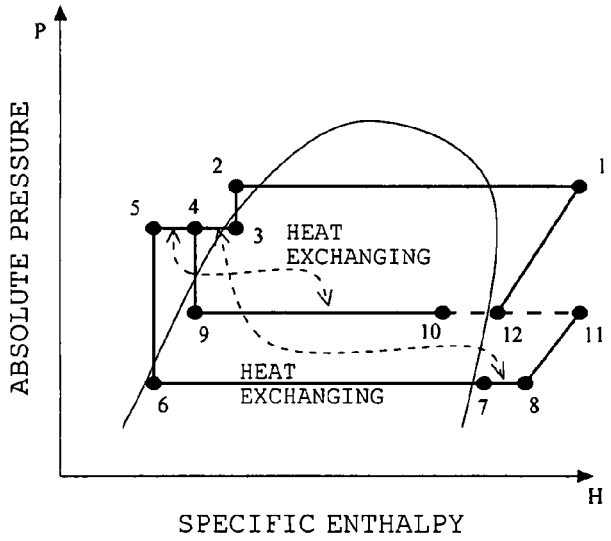
FIG. 2 is a PH diagram showing operating situations during heating operation of the refrigerant air conditioner.

Then, after part of the refrigerant is bypassed to the injection circuit 13, the refrigerant exchanges heat in the second internal heat exchanger 10 with the refrigerant bypassed to the injection circuit 13 and reduced in pressure in the third expansion valve 14 getting a low temperature, so as to be further cooled (the point 5 in FIG. 2). Then, the refrigerant is reduced in pressure to be a low pressure by the first expansion valve 11 so as to become two-phase refrigerant (the point 6 in FIG. 2). Then, the two-phase refrigerant flows in the outdoor heat exchanger 12 as an evaporator so as to be evaporated and gasified therein (the point 7 in FIG. 2) by absorbing heat. Thereafter, it passes through the four-way valve 4 so as to heat exchange in the first internal heat exchanger 9 with high-pressure refrigerant for being further heated (the point 8 in FIG. 2) and sucked into the compressor 3.

On the other hand, the refrigerant bypassed to the injection circuit 13 is reduced in pressure to an intermediate pressure by the third expansion valve 14 so as to become the low temperature two-phase refrigerant (the point 9 in FIG. 2). Thereafter, it changes heat in the second internal heat exchanger 10 with high pressure refrigerant so as to be heated (the point 10 in FIG. 2) for being injected into the compressor 3.

Within the compressor 3, the sucked refrigerant (the point 8 in FIG. 2) is compressed and heated to an intermediate pressure (the point 11 in FIG. 2) and then flows together with the injected refrigerant. The refrigerant is reduced in temperature (the point 12 in FIG. 2), and then discharged (the point 1 in FIG. 2) after being compressed to be high pressure.

Next, the operation during cooling will be described with reference to PH diagrams during cooling operation shown in FIGS. 1 and 3.

During the cooling operation, the flow path of the four-way valve 4 is established in directions shown by dotted lines of FIG. 1. The high temperature and pressure refrigerant gas (the point 1 in FIG. 3) discharged from the compressor 3 flows in the outdoor heat exchanger 12 as a condenser via the four-way valve 4 so as to become high-pressure and low-temperature refrigerant (the point 2 in FIG. 3) by being condensed and liquefied therein while radiating heat. The refrigerant flowing out of the outdoor heat exchanger 12 is slightly reduced in pressure (the point 3 in FIG. 3) in the first expansion valve 11 and subsequently cooled (the point 4 in FIG. 3) in the second internal heat exchanger 10 by exchanging heat with the low-temperature refrigerant flowing along the injection circuit 13. After part of the refrigerant is bypassed to the injection circuit 13, the refrigerant is continuously cooled (the point 5 in FIG. 3) in the first internal heat exchanger 9 by exchanging heat with the refrigerant to be sucked into the compressor 3.

After becoming the two-phase refrigerant (the point 6 in FIG. 3) by being reduced in pressure to a low pressure by the second expansion valve 8, the refrigerant flows out of the outdoor unit 1 so as to flow in the room unit 2 via the liquid pipe 7. Then, it flows in the room heat exchanger 6 as an evaporator so as to give the cold to load-side media, such as air and water, while being evaporated and gasified therein (the point 7 in FIG. 3) by absorbing heat.

The low-pressure refrigerant gas flowing out of the room heat exchanger 6 flows out of the room unit 2 so as to flow into the outdoor unit 1 via the gas pipe 5. Then, it passes through the four-way valve 4, and is subsequently heated (the point 8 in FIG. 3) by exchanging heat with the high-pressure refrigerant in the first internal heat exchanger 9 and then sucked into the compressor 3.

Figure 3:
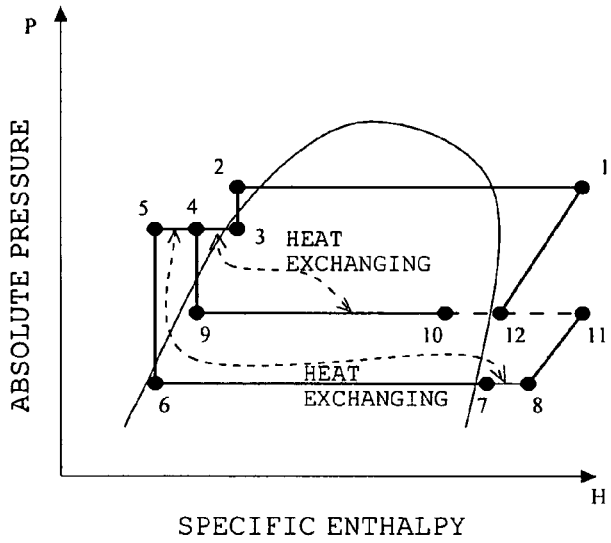
FIG. 3 is a PH diagram showing operating situations during cooling operation of the refrigerant air conditioner.

On the other hand, the refrigerant bypassed to the injection circuit 13 is reduced in pressure to an intermediate pressure by the third expansion valve 14 so as to become the low temperature two-phase refrigerant (the point 9 in FIG. 3). Thereafter, it changes heat in the second internal heat exchanger 10 with high pressure refrigerant so as to be heated (the point 10 in FIG. 3) for being injected into the compressor 3. Within the compressor 3, the sucked refrigerant (the point 8 in FIG. 3) is compressed and heated to an intermediate pressure (the point 11 in FIG. 3) and then flows together with the injected refrigerant. The refrigerant is reduced in temperature (the point 12 in FIG. 3), and then discharged (the point 1 in FIG. 3) after being compressed to be high pressure.

The PH diagram during the cooling operation is substantially identical to that during the heating operation, so that the same way operation can be achieved in any one of the operation modes.

Next, the control operation in the refrigerant air conditioner will be described.

Figure 4:
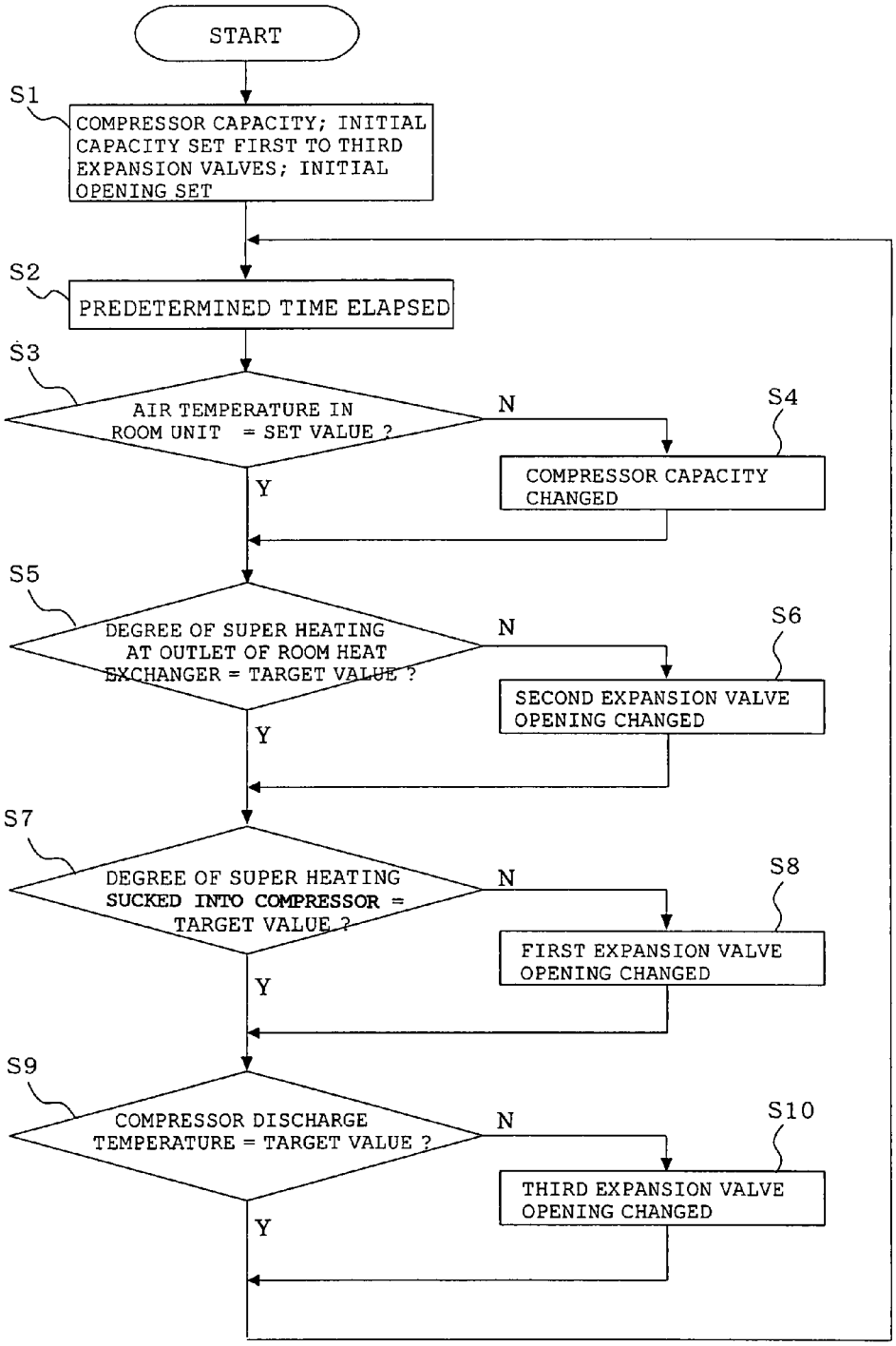
FIG. 4 is a flowchart showing control process during the heating operation of the refrigerant air conditioner.

First, the control operation during the heating operation will be described with reference to the flowchart of FIG. 4.

During the heating operation, the capacity of the compressor 3, the opening of the first expansion valve 11, the opening of the second expansion valve 8, and the opening of the third expansion valve 14 are firstly established as initial values (Step S1).

After a predetermined time elapsed (Step S2), in accordance with the operation state thereafter, each actuator is controlled as follows.

Also, the capacity of the compressor 3 is principally controlled so that the air temperature measured by the temperature sensor **16*j* of the room unit 2** becomes the temperature set by a user of the refrigerant air conditioner.

That is, the air temperature in the room unit 2 is compared with the set value (Step S3). When the air temperature is identical or close to the set temperature, the capacity of the compressor 3 is maintained as it is and the process proceeds to the next Step.

Also, the capacity of the compressor 3 is changed (Step S4) such that when the air temperature is much smaller than the set temperature, the capacity of the compressor 3 is increased; when the air temperature is close to the set temperature, the capacity of the compressor 3 is maintained as it is; and when the air temperature is increased larger than the set temperature, the capacity of the compressor 3 is decreased.

The control of each expansion valve is performed as follows.

First, the second expansion valve 8 is controlled so that the degree of supercooling SC of the refrigerant at the outlet of the room heat exchanger 6 becomes a target value set in advance, such as 10° C., the degree of supercooling SC being obtained from the temperature difference between the saturated temperature of the high-pressure refrigerant detected by the temperature sensor 16*h* and the outlet temperature of the room heat exchanger 6 detected by the temperature sensor 16*i*.

That is, the degree of supercooling SC of the refrigerant at the outlet of the room heat exchanger 6 is compared to the target value (Step S5). When the degree of supercooling SC of the refrigerant at the outlet of the room heat exchanger 6 is identical or close to the target value, the opening of the second expansion valve 8 is maintained as it is and the process proceeds to the next Step.

Also, the opening of the second expansion valve 8 is changed (Step S6) such that when the degree of supercooling SC of the refrigerant at the outlet of the room heat exchanger 6 is larger than the target value, the opening of the second expansion valve 8 is increased; and when the degree of supercooling SC is smaller than the target value, the opening of the second expansion valve 8 is controlled to be smaller.

Then, the first expansion valve 11 is controlled so that the degree of super heating SH of the refrigerant at the inlet of the compressor 3 becomes a target value set in advance, such as 10° C., the degree of super heating SH being detected from the temperature difference between the inlet temperature of the compressor 3 detected by the temperature sensor 16*f* and the saturated temperature of the low-pressure refrigerant detected by the temperature sensor 16*c*.

That is, the degree of super heating SH of the refrigerant at the inlet of the compressor 3 is compared to the target value (Step S7). When the degree of super heating SH of the refrigerant at the inlet of the compressor 3 is identical or close to the target value, the opening of the first expansion valve 11 is maintained as it is and the process proceeds to the next Step.

Also, the opening of the first expansion valve 11 is changed (Step S8) such that when the degree of super heating SH of the refrigerant at the inlet of the compressor 3 is larger than the target value, the opening of the first expansion valve 11 is increased; and when the degree of super heating SH is smaller than the target value, the opening of the first expansion valve 11 is controlled to be smaller.

Furthermore, the third expansion valve 14 is controlled so that the discharge temperature of the compressor 3 detected by the temperature sensor 16*a* becomes a target value set in advance, such as 90° C.

That is, the discharge temperature of the compressor 3 is compared to the target value (Step S9). When the discharge temperature of the compressor 3 is identical or close to the target value, the opening of the third expansion valve 14 is maintained as it is so as to return to Step S2.

When the opening of the third expansion valve 14 is varied, the refrigerant state is changed as follows.

When the opening of the third expansion valve 14 is increased, the refrigerant flow rate flowing through the injection circuit 13 is increased. Since the heat exchanging amount of the second internal heat exchanger 10 does not largely change according to the flow of the injection circuit 13. Therefore, when the refrigerant flow rate flowing through the injection circuit 13 is increased, the refrigerant enthalpy difference (the difference between the point 9 and the point 10 in FIG. 2) in the second internal heat exchanger 10 on the side of the injection circuit 13 is decreased, so that the enthalpy of the injected refrigerant (the point 10 in FIG. 2) is reduced.

Accordingly, the enthalpy of the refrigerant having the injected and confluent refrigerant (the point 12 in FIG. 2) is also reduced, so that the discharge enthalpy of the compressor 3 (the point 1 in FIG. 2) is also reduced, decreasing the discharge temperature of the compressor 3.

In contrast, when the opening of the third expansion valve 14 is reduced, the discharge enthalpy of the compressor 3 increases so that the discharge temperature of the compressor 3 is increased. Thus, the opening of the third expansion valve 14 is controlled to change (Step S10) such that when the discharge temperature of the compressor 3 is larger than the target value, the opening of the third expansion valve 14 is controlled to be larger; and when the discharge temperature of the compressor 3 is inversely smaller than the target value, the opening of the third expansion valve 14 is controlled to be smaller. Thereafter, the process returns to Step S2.

Figure 5:
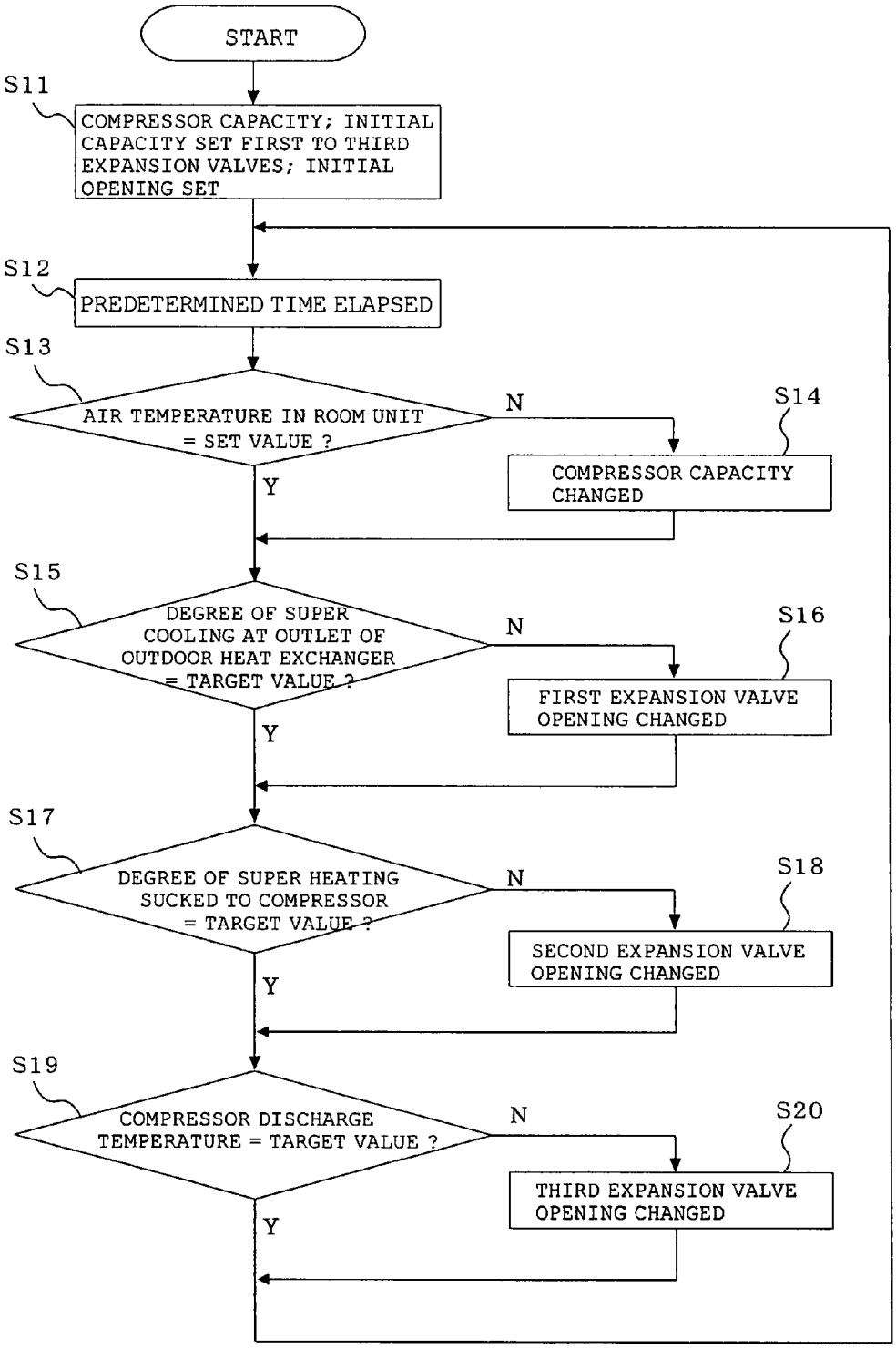
FIG. 5 is a flowchart showing control process during the cooling operation of the refrigerant air conditioner.

Next, the control operation during the cooling operation will be described with reference to the flowchart of FIG. 5.

During the cooling operation, the capacity of the compressor 3, the opening of the first expansion valve 11, the opening of the second expansion valve 8, and the opening of the third expansion valve 14 are firstly established as initial values (Step S11).

After a predetermined time elapsed (Step S12), in accordance with the operation state thereafter, each actuator is controlled as follows.

First, the capacity of the compressor 3 is principally controlled so that the air temperature measured by the temperature sensor 16*j* of the room unit 2 becomes the temperature set by a user of the refrigerant air conditioner.

That is, the air temperature in the room unit 2 is compared with the set temperature (Step S13). When the air temperature is identical or close to the set temperature, the capacity of the compressor 3 is maintained as it is and the process proceeds to the next Step.

Also, the capacity of the compressor 3 is changed (Step S14) such that when the air temperature is much greater than the set temperature, the capacity of the compressor 3 is increased; and when the air temperature is smaller than the set temperature, the capacity of the compressor 3 is reduced.

The control of each expansion valve is performed as follows.

First, the first expansion valve 11 is controlled so that degree of supercooling SC of the refrigerant at the outlet of the outdoor heat exchanger 12 becomes a target value set in advance, such as 10° C., the degree of supercooling SC being obtained from the temperature difference between the saturated temperature of the high-pressure refrigerant detected by the temperature sensor 16*c* and the outlet temperature of the outdoor heat exchanger 12 detected by the temperature sensor 16*d*.

That is, the degree of supercooling SC of the refrigerant at the outlet of the outdoor heat exchanger 12 is compared to the target value (Step S15). When the degree of supercooling SC of the refrigerant at the outdoor heat exchanger 12 is identical or close to the target value, the opening of the first expansion valve 11 is maintained as it is and the process proceeds to the next Step.

Also, the opening of the first expansion valve 11 is changed (Step S16) such that when the degree of supercooling SC of the refrigerant at the outdoor heat exchanger 12 is larger than the target value, the opening of the first expansion valve 11 is increased; and when the degree of supercooling SC is smaller than the target value, the opening of the first expansion valve 11 is controlled to be smaller.

Then, the second expansion valve 8 is controlled so that degree of super heating SH of the refrigerant at the inlet of the compressor 3 becomes a target value set in advance, such as 10° C., the degree of super heating SH being detected from the temperature difference between the inlet temperature of the compressor 3 detected by the temperature sensor 16*f* and the saturated temperature of the low-pressure refrigerant detected by the temperature sensor 16*h*.

That is, the degree of super heating SH of the refrigerant at the inlet of the compressor 3 is compared to the target value (Step S17). When the degree of super heating SH of the refrigerant at the inlet of the compressor 3 is identical or close to the target value, the opening of the second expansion valve 8 is maintained as it is and the process proceeds to the next Step.

Also, the opening of the second expansion valve 8 is changed (Step S18) such that when the degree of super heating SH of the refrigerant at the inlet of the compressor 3 is larger than the target value, the opening of the second expansion valve 8 is increased; and when the degree of super heating SH is smaller than the target value, the opening of the second expansion valve 8 is controlled to be smaller.

Then, the third expansion valve 14 is controlled so that the discharge temperature of the compressor 3 detected by the temperature sensor 16*a* becomes a target value set in advance, such as 90° C.

That is, the discharge temperature of the compressor 3 is compared to the target value (Step S19). When the discharge temperature of the compressor 3 is identical or close to the target value, the opening of the third expansion valve 8 is maintained as it is so as to return to Step S12.

The refrigerant state is changed in the same way as in the heating operation when the opening of the third expansion valve 14 is varied. Therefore, the opening of the third expansion valve 14 is changed (Step S20) such that when the discharge temperature of the compressor 3 is larger than the target value, the opening of the third expansion valve 14 is increased; and when the discharge temperature is inversely smaller than the target value, the opening of the third expansion valve 14 is controlled to be smaller. Thereafter, the process returns to Step S12.

Next, the operation/working-effect achieved by the circuit configuration and the control according to the embodiment will be described. Since the refrigerant air conditioner with the constitution can be operated in the same way in any of the cooling and heating modes, the heating operation will be representatively described below.

The circuit of the refrigerant air conditioner is a so-called gas injection circuit. That is, the refrigerant gas in part of the refrigerant, which is reduced in pressure to an intermediate pressure after flowing out of the room heat exchanger 6 as a condenser is injected into the compressor 3.

Figure 6:
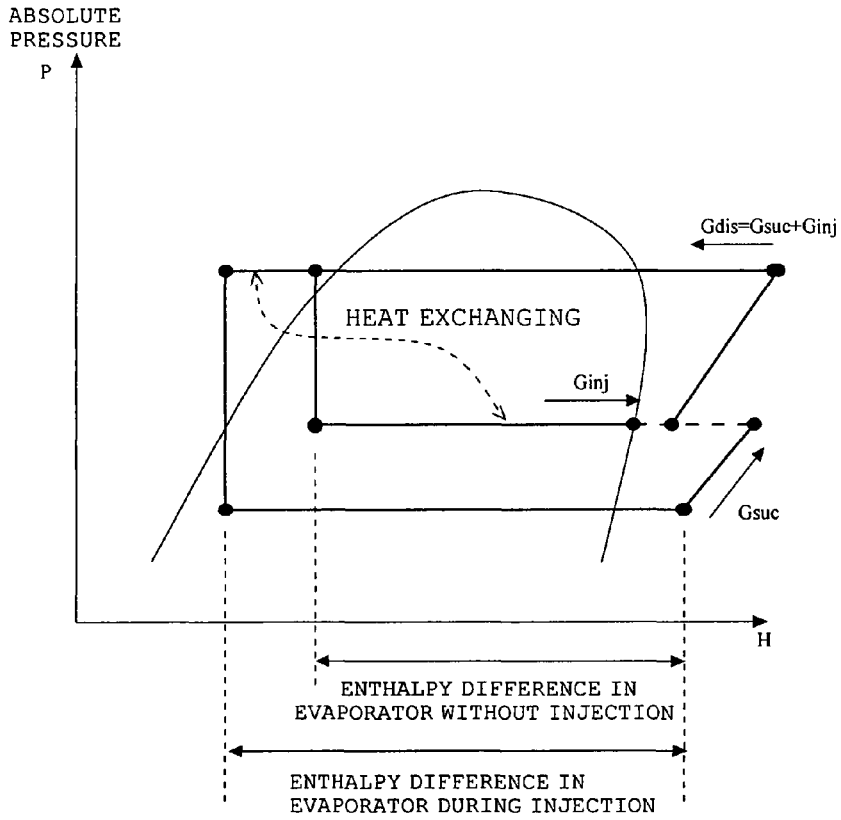
FIG. 6 is a PH diagram showing operating situations during gas injection of the refrigerant air conditioner.

In general, the refrigerant at an intermediate pressure is conventionally separated into liquid and gas in the gas liquid separator so as to be injected. Whereas, in this apparatus, as shown in FIG. 6, the refrigerant is thermally separated into liquid and gas by exchanging heat in the second internal heat exchanger 10 so as to be injected.

The gas injection circuit achieves the following effects.

First, by the gas injection, the refrigerant flow discharged from the compressor 3 is increased, so that the refrigerant flow Gdis discharged from the compressor 3=the refrigerant flow Gsuc sucked to the compressor 3+the injected refrigerant flow Ginj.

Thus, since the refrigerant flow entering the heat exchanger as a condenser is increased, the heating capacity is increased during the heating operation.

On the other hand, by exchanging heat in the second internal heat exchanger 10, as shown in FIG. 6, the refrigerant enthalpy entering the heat exchanger as an evaporator is reduced, so that the refrigerant enthalpy difference at the evaporator is increased. Hence, the cooling capacity is increased even during the cooling operation.

Also, the gas injection achieves the improving of the efficiency.

The refrigerant entering the evaporator is generally the gas-liquid two-phase refrigerant and among them, the refrigerant gas does not contribute to the cooling capacity. When viewed from the compressor 3, the compressor 3 works for highly pressurizing this low-pressure refrigerant gas together with the refrigerant gas evaporated in the evaporator.

During the gas injection, certain part of the refrigerant gas entering the evaporator is extracted at an intermediate pressure and injected, so that the gas is compressed from the intermediate pressure to the high pressure.

Hence, the compression work from the low pressure to the intermediate pressure is not necessary for the injected refrigerant gas flow, so that the efficiency is improved by that much. This effect can be obtained at any of cooling and heating operations.

Next, the correlation between the gas injection flow and the heating capacity will be described.

When the gas injection flow is increased, while the refrigerant flow discharged from the compressor 3 is increased as described above, the discharge temperature of the compressor 3 is reduced and the temperature of the refrigerant entering the condenser is also decreased.

Figure 7:
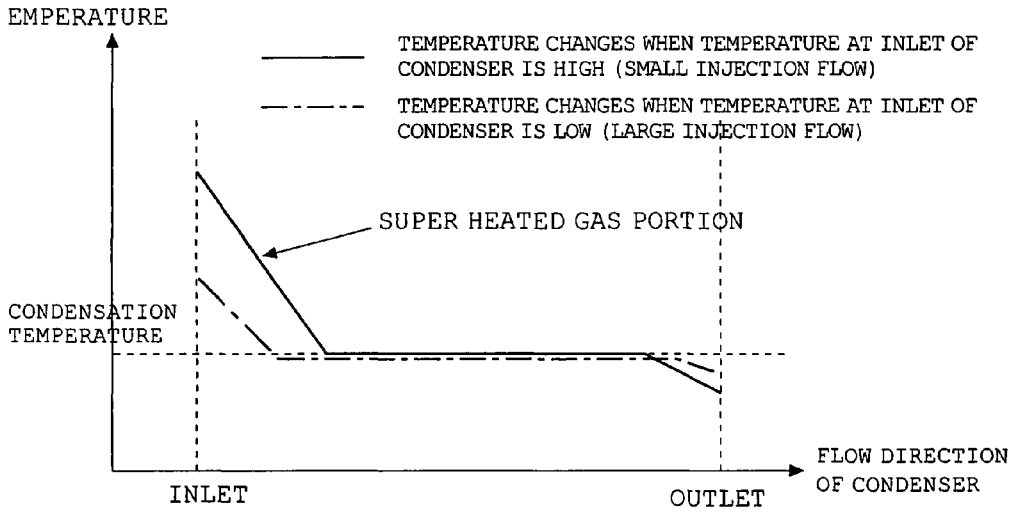
FIG. 7 is a graph showing temperature changes of a condenser during the gas injection of the refrigerant air conditioner.

As for the heat exchanging capacity of the condenser, with increasing temperature distribution in the heat exchanger, the heat exchanging capacity is generally increased. The changes in refrigerant temperature in the case when the refrigerant temperature at the inlet of the condenser is different at the same condensation temperature are shown in FIG. 7, so that the temperature distribution is different in the part where the refrigerant in the condenser is in a super-heated gas state.

In the condenser, the heat exchanging amount dominates a large part when the refrigerant is in a two-phase state at the condensation temperature. However, the heat exchanging amount in the part where the refrigerant is in a super heated gas state also exists about 20% to 30% of its total, having the large effect on the heat exchanging amount.

Figure 8:
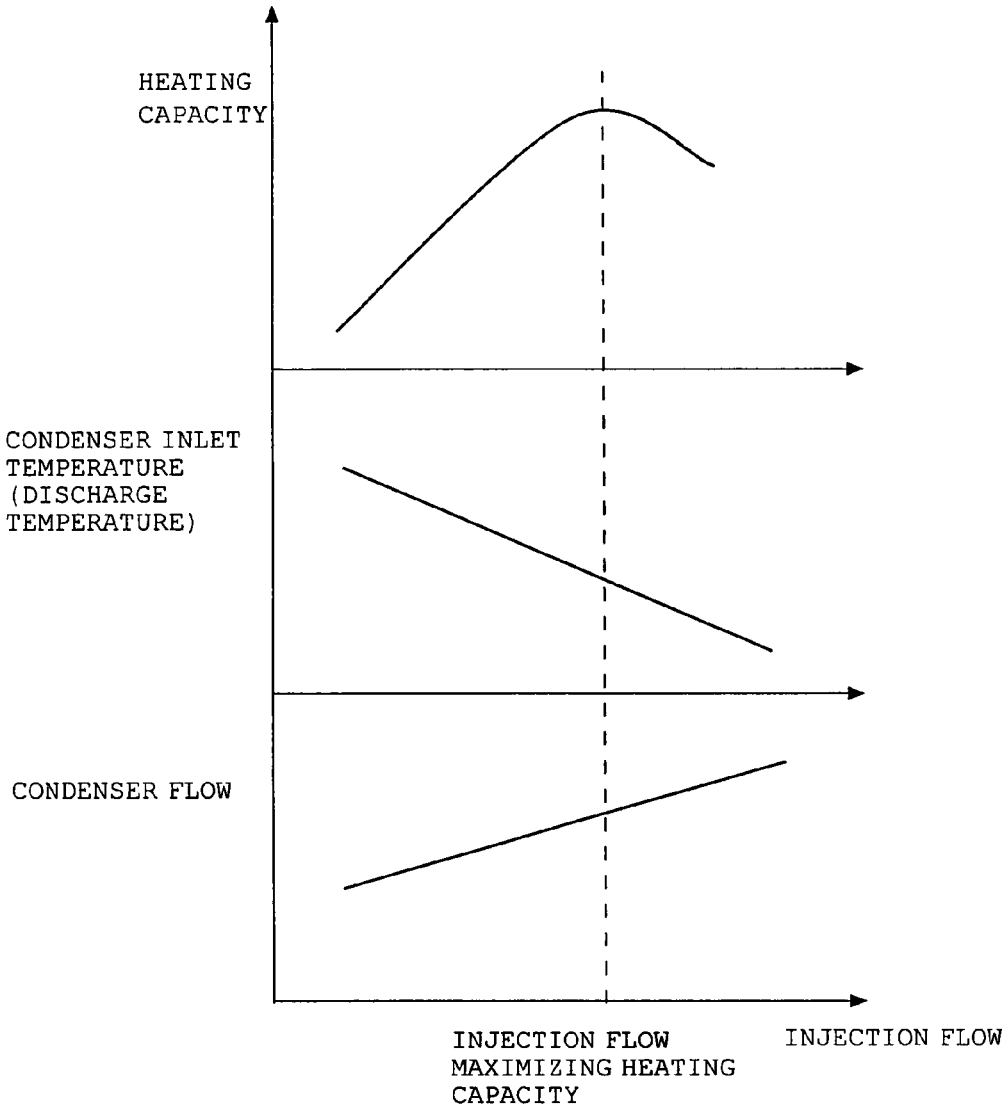
FIG. 8 is a graph showing operation characteristics during changing of the gas injection flow rate of the refrigerant air conditioner.

If the injection flow is excessively increased and the refrigerant temperature in the super-heated gas part is largely reduced, the heat exchanging capacity in the condenser is decreased and the heating capacity is also reduced. The above-mentioned correlation between the gas injection flow and the heating capacity is depicted as in FIG. 8, so that the gas injection flow maximizing the heating capacity exists.

Next, the operation/working-effect of the first internal heat exchanger 9 according to the embodiment will be described.

In the first internal heat exchanger 9, the high-pressure refrigerant liquid flowing out of the condenser exchanges heat with the refrigerant sucked into the compressor 3. By cooling the high-pressure refrigerant liquid in the first internal heat exchanger 9, the enthalpy of the refrigerant flowing into the evaporator is reduced, so that the refrigerant enthalpy difference is increased in the evaporator.

Thus, the cooling capacity is increased during the cooling operation.

On the other hand, the refrigerant sucked into the compressor 3 is heated so that the sucking temperature increases. Along with this, the discharge temperature of the compressor 3 is also increased. In the compression stroke of the compressor 3, even in the same pressure rise, the higher temperature refrigerant is compressed, the more work is generally required.

Therefore, in the effect of the first internal heat exchanger 9 on the efficiency, there are both the capacity up due to the increase in enthalpy difference of the evaporator and the increase in compression work. When the effect of the capacity up due to the increase in enthalpy difference of the evaporator is larger, the operating efficiency of the apparatus is improved.

Next, the effect of the combination of the heat exchanging in the first internal heat exchanger 9 and the gas injection with the injection circuit 13, like in the embodiment, will be described.

When heat is exchanged by the first internal heat exchanger 9, the sucking temperature of the compressor 3 is increased. Hence, in the change within the compressor 3 during the injection, the enthalpy of the refrigerant pressurized from the low pressure to the intermediate pressure (the point 11 of FIGS. 2 and 3) is increased, and the enthalpy of the refrigerant after merging with the refrigerant to be injected (the point 12 of FIGS. 2 and 3) is also increased.

Accordingly, the discharge enthalpy of the compressor 3 (the point 1 of FIGS. 2 and 3) is also increased, so that the discharge temperature of the compressor 3 increases. Then, the correlation between the gas injection flow and the heating capacity, accompanied with the presence or absence of the heat exchange by the first internal heat exchanger 9 is depicted as in FIG. 9.

When the heat exchange by the first internal heat exchanger 9 is present, the discharge temperature of the compressor 3 in the case when the same amount is injected is increased, so that the refrigerant temperature at the inlet of the condenser is also increased and the heat exchanging amount in the condenser is increased so as to improve the heating capacity. Hence, the injection flow with which the heating capacity has the peak value is increased and the peak value itself is also increased, thereby obtaining more heating capacity.

In addition, even if the first internal heat exchanger 9 is absent, the degree of the supper heating of the sucked refrigerant into the compressor 3 is increased by the opening control of the first expansion valve 11, so that the discharge temperature of the compressor 3 can be increased.

However, since the degree of the supper heating of the refrigerant at the outlet of the outdoor heat exchanger 12 as an evaporator is also increased simultaneously in this case, the heat exchanging efficiency of the outdoor heat exchanger 12 is reduced.

When the heat exchanging efficiency of the outdoor heat exchanger 12 is reduced, the evaporation temperature must be reduced for obtaining the same heat exchanging capacity, so that the low pressure is reduced in operation.

When the low pressure is reduced, the refrigerant flow sucked into the compressor 3 is also reduced, so that by such an operation, the heating capacity is contrarily deteriorated.

On the contrary hand, use of the first internal heat exchanger 9 makes the refrigerant state at the outlet of the outdoor heat exchanger 12 as an evaporator suitable, so that the discharge temperature of the compressor 3 can be raised while maintaining the suitable heat exchanging efficiency, easily achieving the increase of the heating capacity by avoiding the above-mentioned reduction in low pressure.

Also, in the circuit configuration according to the embodiment, the injection is performed after part of the high-pressure refrigerant is bypassed and reduced in pressure, and then super heating gasified in the second internal heat exchanger 10.

Hence, in comparison with the case where the gas separated by the gas liquid separator is injected like in the conventional example, the change in refrigerant flow distribution is not generated when the injection flow is varied according to the control and operation state, so that more stable operation can be achieved.

In addition, though it has been described that the third expansion valve 14 is controlled so that the discharge temperature of the compressor 3 has a target value, the control target value is set so that the heating capacity is maximized.

Figure 9:
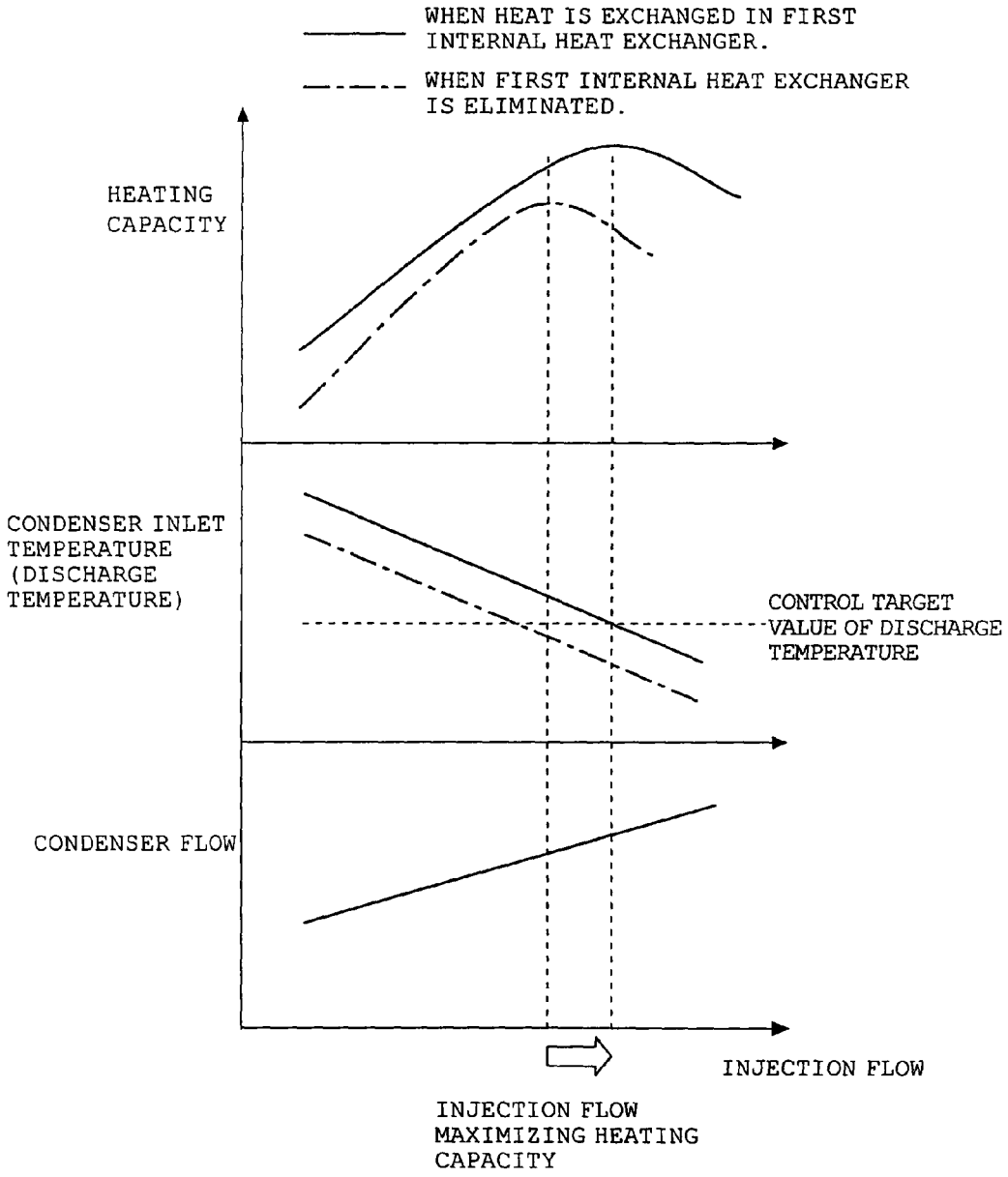
FIG. 9 is a graph showing differences in operation characteristics due to presence or absence of a first internal heat exchanger of the refrigerant air conditioner.

As shown in FIG. 9, from the correlation between gas injection flow, the heating capacity, and the discharge temperature, a discharge temperature maximizing the heating capacity exists, so that this discharge temperature is obtained in advance for setting it as the target value. The target value of the discharge temperature is not necessarily constant, so that it may be changed according to the operation conditions and characteristics of instruments such as a condenser.

By controlling the discharge temperature in such a manner, the gas injection flow can be controlled to maximize the heating capacity.

The gas injection flow can be controlled not only to maximize the heating capacity but also to maximize the operation efficiency.

When the much heating capacity is required like during the starting of the refrigerant air conditioner, the gas injection flow is controlled to maximize the heating capacity. Whereas, when the room temperature is increased after a predetermined lapse of time since the starting of the apparatus, the gas injection flow may be controlled to maximize the operation efficiency because the heating capacity is not so much required in such a case.

Figure 10:
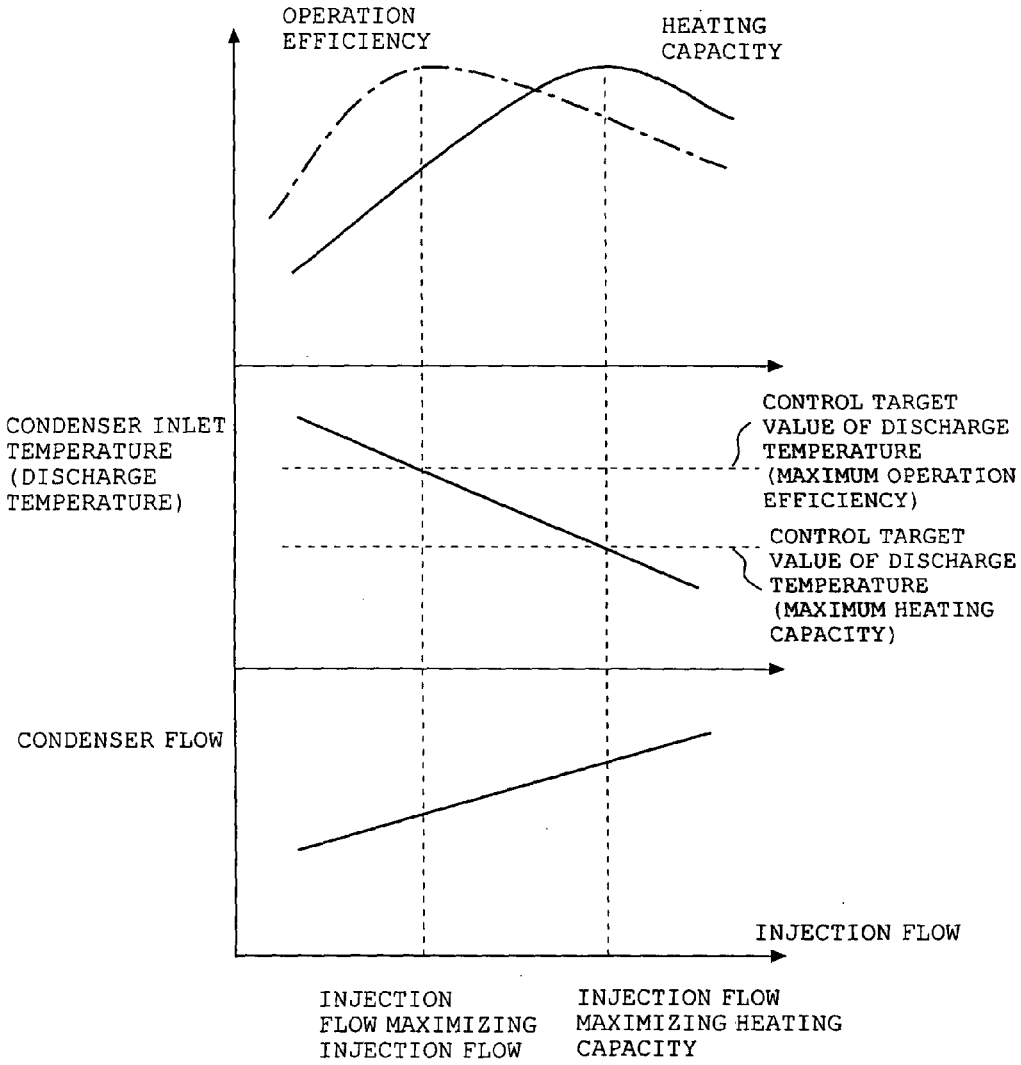
FIG. 10 is another graph showing operation characteristics during the changing of the gas injection flow rate of the refrigerant air conditioner.

Between the injection flow, the heating capacity, and the operation efficiency, there are correlations as shown in FIG. 10, so that when the operation efficiency is maximized, the injection flow is smaller and the discharge temperature is higher in comparison with the case when the heating capacity is maximized.

In the injection flow maximizing the heating capacity, the heat exchanging capacity of the condenser is reduced because the discharge temperature is lowered. Also, in order to increase the injection flow, the intermediate pressure is decreased and the compression work increases by the injected amount, so that the operation efficiency is reduced in comparison with the case when the operation efficiency is maximized.

Then, the target value of the discharge temperature controlled by the third expansion valve 14 in the injection circuit 13 has not only a target value maximizing the heating capacity but also a target value maximizing the operating efficiency. Thereby, in accordance with operating situations, such as the operating capacity of the compressor 3 and air temperatures around the room unit, when the heating capacity is required, the target value maximizing the heating capacity is set; in other situations, the target value maximizing the operating efficiency is set.

By such a operation, while achieving the much heating capacity, highly efficient operation can be performed.

Also, the first expansion valve 11 is controlled so that the degree of super heating of the refrigerant to be sucked into the compressor 3 has a predetermined value. Thereby, the degree of super heating of the refrigerant at the outlet of the heat exchanger as an evaporator can be optimized so as to secure the high heat exchanging capacity in the evaporator as well as the suitable refrigerant enthalpy difference, permitting highly efficient operation.

The degree of super heating of the refrigerant at the outlet of the evaporator for such an operation depends on characteristics of the heat exchanger, but it is about 2° C. Since the refrigerant is heated in the first internal heat exchanger 9 from this degree, the target value of the degree of super heating of the refrigerant to be sucked into the compressor 3 becomes higher than this degree, so that it is set at 10° C. as described above as a target valve.

Accordingly, in the first expansion valve 11, the degree of super heating of the refrigerant at the outlet of the evaporator or the degree of super heating of the refrigerant at the outlet of the outdoor heat exchanger 12, during the heating operation, which are obtained from the temperature difference between the temperature sensor 16*b* and the temperature sensor 16*c*, may also be controlled so as to have a target value such as 2° C. as mentioned above.

However, in the case when the degree of super heating of refrigerant at the outlet of the evaporator is directly controlled, if the target value is low such as 2° C., the refrigerant at the outlet of the evaporator transiently becomes in a gas-liquid two-phase state, so that the degree of super heating cannot be suitably detected, resulting in difficult control.

By detecting the degree of super heating of the refrigerant to be sucked into the compressor 3, the target value can be set high, and such a situation is not generated owing to heating in the first internal heat exchanger 9, that the degree of super heating cannot be suitably detected because the sucked refrigerant is in a gas-liquid two-phase state, so that the degree of super heating can be easily and stably controlled.

Also, in the second expansion valve 8, the degree of super cooling of the refrigerant at the outlet of the room heat exchanger 6 as a condenser is controlled so as to have a target value. By this control, the heat exchanging capacity in the condenser can be highly secured as well as the apparatus can be operated so as to suitably secure the refrigerant enthalpy difference, permitting highly efficient operation.

The degree of super cooling of the refrigerant at the outlet of the condenser for such an operation depends on characteristics of the heat exchanger, but it is about 5 to 10° C.

In addition, the target value of the degree of super cooling is set higher than this value. By setting it at about 10 to 15° C., for example, the apparatus can be operated so as to increase the heating capacity.

Then, the target value of the degree of super cooling is changed in accordance with operation situations, so that during the starting of the apparatus, the heating capacity may also be secured with a slightly higher degree of super cooling, and at the time when the room temperature is stabilized, the highly efficient operation may also be performed with a slightly lower degree of super cooling.

In addition, the refrigerant for the refrigerant air conditioner is not limited to R410A, so that other refrigerants, such as R134a, R404A, R407c, which are HFC refrigerants, $CO_2$, which is a natural refrigerant, HC refrigerants, ammonia, air, and water, may be used. In particular, when $CO_2$ is used as refrigerant, it has a disadvantage that the refrigerant enthalpy difference is small in the evaporator reducing the operating efficiency. However, in the configuration of this apparatus, since the refrigerant enthalpy difference of the evaporator can be increased by the first internal heat exchanger 9 and the second internal heat exchanger 10, the efficiency can be more largely improved, so that $CO_2$ is suitably applied to the apparatus.

In the case of $CO_2$, the condensation temperature does not exist, and in the high-pressure side heat exchanger as a radiator, the temperature decreases along with the flow. Hence, different from the HFC refrigerant in which a certain amount of heat exchange is secured by the condensation temperature kept through a certain section, the change in heat exchange amount in the evaporator is largely influenced by the inlet temperature.

Thus, according to the embodiment in that the injection flow can be increased while the discharge temperature being maintained high, the increasing rate of the heating capacity becomes larger than the HFC refrigerants, so that the $CO_2$ refrigerant can be suitably incorporated in the apparatus also in this respect.

The arrangement of the first internal heat exchanger 9 and the second internal heat exchanger 10 is not limited to that shown in FIG. 1, so that the same effect can be obtained even the positional relationship between upstream and downstream is reversed. Also, the deriving position to the injection circuit 13 is not limited to that shown in FIG. 1, so that the same effect can be obtained as long as it is other positions in the intermediate pressure part and the high pressure liquid part.

In addition, in view of the control stability of the third expansion valve 14, as the deriving position to the injection circuit 13, a position where the refrigerant is in a complete liquid state is preferable rather than that where the refrigerant is in a gas-liquid two-phase state.

In addition, according to the embodiment, the first internal heat exchanger 9, the second internal heat exchanger 10 and the deriving position to the injection circuit 13 are arranged between the first expansion valve 11 and the third expansion valve 8, so that the operation with the injection can be performed in any of the heating and cooling modes.

Also, the refrigerant saturation temperature is detected by the refrigerant temperature sensor arranged between the condenser and the evaporator; alternatively, a pressure sensor for detecting high-low pressure may be provided so that the saturation temperature is obtained by converting the measured pressure value.

Second Embodiment

Figure 11:
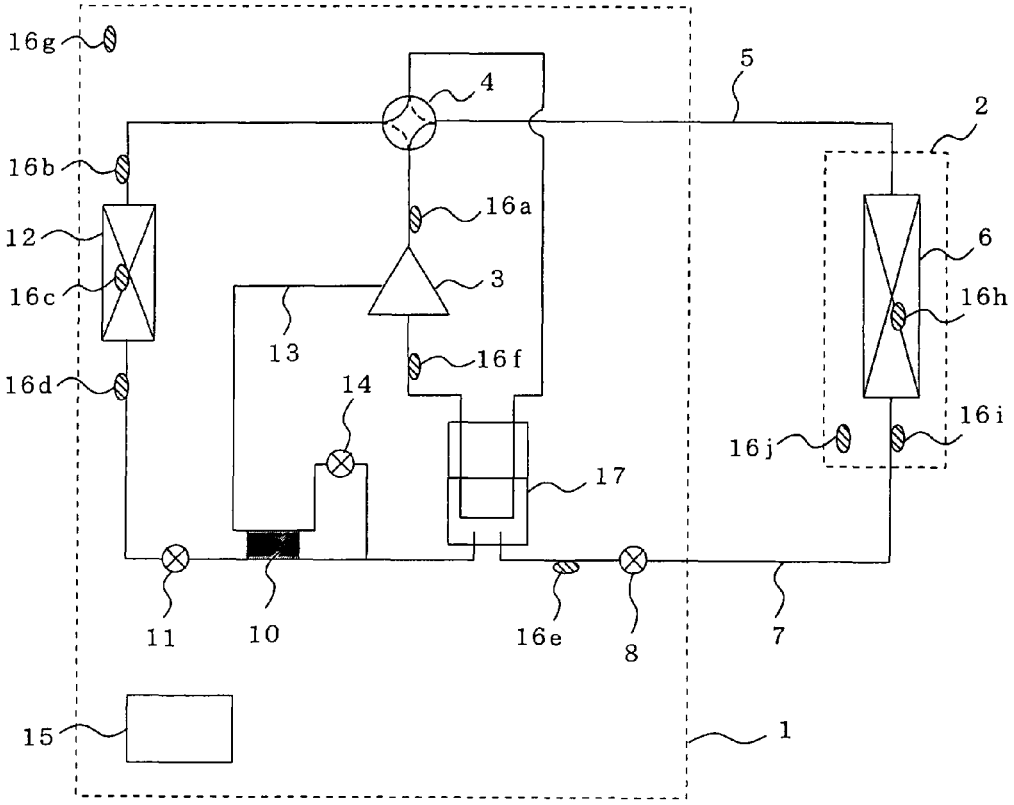
FIG. 11 is a refrigerant circuit diagram of a refrigerant air conditioner according to a second embodiment of the present invention.

A second embodiment of the present invention is shown in FIG. 11. FIG. 11 is a refrigerant circuit diagram of a refrigerant air conditioner according to the second embodiment, in that an intermediate pressure receiver 17 is provided in the outdoor unit, and a suction pipe of the compressor 3 penetrates the inside of the intermediate pressure receiver 17.

The heat of refrigerant existing in the pipe penetrating portion can be exchanged with that of the refrigerant contained in the intermediate pressure receiver 17, achieving the same function as that of the first internal heat exchanger 9 according to the first embodiment.

The operation/working-effect achieved by this embodiment are the same as those of the first embodiment except for the intermediate pressure receiver 17, so that the description of the same portion is omitted. During the heating operation, the gas-liquid two-phase refrigerant at the outlet of the room heat exchanger 6 flows into the intermediate pressure receiver 17 so as to be cooled and liquefied in the intermediate pressure receiver 17, and it flows out. During the cooling operation, the gas-liquid two-phase refrigerant at the outlet of the first expansion valve 11 flows thereinto so as to be cooled and liquefied in the intermediate pressure receiver 17, and it flows out.

In the heat exchange in the intermediate pressure receiver 17, the refrigerant gas among thee gas-liquid two-phase refrigerant mainly touches the suction pipe so as to be condensed and liquefied. Hence, the smaller the amount of the refrigerant liquid stored in the intermediate pressure receiver 17 is, the large the contact area between the refrigerant gas and the suction pipe becomes, so that the heat exchanging amount increases. In contrast, the larger the amount of the refrigerant liquid stored in the intermediate pressure receiver 17 is, the smaller the contact area between the refrigerant gas and the suction pipe becomes, so that the heat exchanging amount decreases.

Provision of the intermediate pressure receiver 17 in such a manner has the following effects.

First, since the refrigerant is liquefied at the outlet of the intermediate pressure receiver 17, the refrigerant flowing in the third expansion valve 14 certainly becomes refrigerant liquid during the heating operation, so that the flowing characteristics in the third expansion valve 14 are stabilized and the stable control is secured, enabling the apparatus to be stably operated.

By the heat exchange in the intermediate pressure receiver 17, there are advantages that the pressure in the intermediate pressure receiver 17 is stabilized; the inlet pressure of the third expansion valve 14 becomes stable; and the refrigerant flow flowing through the injection circuit 13 is stabilized. If the load is changed so that the high-pressure varies, for example, the pressure in the intermediate pressure receiver 17 is changed along therewith; however, the pressure change is suppressed due to the heat exchange in the intermediate pressure receiver 17.

When the load increases and the high-pressure is increased, the pressure in the intermediate pressure receiver 17 is also increased; at this time, the pressure difference to the low-pressure is expanded and the temperature difference in the heat exchanger in the intermediate pressure receiver 17 is also increased, increasing the exchanging heat amount. When the exchanging heat amount is increased, the condensing amount of the refrigerant gas among gas-liquid two-phase refrigerant increases, so that the pressure is difficult to increase and the rise in pressure of the intermediate pressure receiver 17 is suppressed.

Conversely, when the load decreases and the high-pressure is decreased, the pressure in the intermediate pressure receiver 17 is also reduced; at this time, the pressure difference to the low-pressure is also reduced and the temperature difference in the heat exchanger in the intermediate pressure receiver 17 is also decreased, reducing the exchanging heat amount. When the exchanging heat amount is reduced, the condensing amount of the refrigerant gas among gas-liquid two-phase refrigerant decreases, so that the pressure is difficult to decrease and the reduction in pressure of the intermediate pressure receiver 17 is suppressed.

In such a manner, by the heat exchange in the intermediate pressure receiver 17, the change in exchanging heat amount accompanying the change in operating conditions is autonomously generated, resulting in suppression of the change in pressure in the intermediate pressure receiver 17.

The heat exchange in the intermediate pressure receiver 17 also has an effect that the apparatus operation itself is stabilized. For example, when the degree of super heating of the refrigerant at the outlet of the outdoor heat exchanger 12 as an evaporator is increased due to change in low-pressure side state, the temperature difference during the heat exchanging in the intermediate pressure receiver 17 is decreased; the exchanging heat amount decreases; and the refrigerant gas is difficult to be condensed, so that the amount of the refrigerant gas in the intermediate pressure receiver 17 increases and the refrigerant liquid decreases.

The decreased amount of the refrigerant liquid moves to the outdoor heat exchanger 12 so as to increase the amount of the refrigerant liquid in the outdoor heat exchanger 12, so that the increase in the degree of super heating of the refrigerant at the outlet of the outdoor heat exchanger 12 is suppressed, restricting changes in apparatus operation.

Conversely, when the degree of super heating of the refrigerant at the outlet of the outdoor heat exchanger 12 as an evaporator is decreased due to change in low-pressure side state, the temperature difference during the heat exchanging in the intermediate pressure receiver 17 is increased; the exchanging heat amount increases; and the refrigerant gas is liable to be condensed, so that the amount of the refrigerant gas in the intermediate pressure receiver 17 decreases and the refrigerant liquid increases. The increased amount of the refrigerant liquid moves from the outdoor heat exchanger 12 so as to reduce the amount of the refrigerant liquid in the outdoor heat exchanger 12, so that the decrease in the degree of super heating of the refrigerant at the outlet of the outdoor heat exchanger 12 is suppressed, restricting changes in apparatus operation.

The effect suppressing the change in degree of super heating also comes from the fact that the change in exchanging heat amount accompanying the change in operating conditions is autonomously generated.

As described above, by replacing the first internal heat exchanger 9 according to the first embodiment with the intermediate pressure receiver 17, even when the apparatus operation changes, the change is suppressed with the autonomous change in exchanging heat amount, so that the apparatus can be stably operated.

As for the structure for heat exchanging in the intermediate pressure receiver 17, any structure has the same effect as long as it exchanges heat with the refrigerant in the intermediate pressure receiver 17. For example, the heat may be exchanged by bringing the suction pipe of the compressor 3 into contact with the external periphery of the container of the intermediate pressure receiver 17.

Also, the refrigerant in the injection circuit 13 may be supplied from the bottom of the intermediate pressure receiver 17. In this case, in both the heating and cooling operations, the refrigerant liquid flows into the third expansion valve 14, so that flow characteristics in the third expansion valve 14 is stabilized in any of the heating and cooling modes, securing control stability.

The invention claimed is:

1. Heating equipment, which includes a refrigerant circuit in which a first heat exchanger that makes a refrigerant absorb heat;

a compressor that sucks the refrigerant that has passed the first heat exchanger;

a second heat exchanger that radiates heat of the refrigerant discharged from the compressor; and a first expansion valve that decompresses the refrigerant flowing from the second heat exchanger to the first heat exchanger are connected so as to circulate the refrigerant, and the heating equipment utilizes heat radiated from the second heat exchanger, the heating equipment comprising;

a third heat exchanger that provides heat of the refrigerant flowing from the second heat exchanger to the refrigerant flowing from the first heat exchanger toward the compressor;

an injection circuit that merges part of the refrigerant flowing from the second heat exchanger to the first heat exchanger with the refrigerant that is sucked by the compressor via the first heat exchanger to be compressed to an intermediate pressure;

an injection circuit expansion valve that is installed in the injection circuit and decompresses the refrigerant flowing in the injection circuit, a fourth heat exchanger that is installed in the refrigerant circuit and the injection circuit and supplies heat of the refrigerant flowing from the second heat exchanger toward the first heat exchanger to the refrigerant flowing in the injection circuit, a first temperature sensor detecting a temperature of the refrigerant discharged from the compressor, a second temperature sensor detecting a temperature of air to be sucked into a room unit, and a controller that controls an opening degree of the injection circuit expansion valve such that when a discharge temperature of the refrigerant detected by the first temperature sensor is higher than a predetermined target value, the opening degree is made to be larger so as to decrease an enthalpy of the refrigerant, and when the discharge temperature is lower than the predetermined target value, the opening degree is made to be smaller so as to increase the enthalpy of the refrigerant, thereby regulating a heating capacity of the second heat exchanger, wherein the target value of the discharge temperature is changeable by the controller according to operating conditions including an air temperatures detected by the second temperature sensor and characteristics of the second heat exchanger.

2. The heating equipment of claim 1, wherein the injection circuit branches from between the second heat exchanger and the first expansion valve.

3. The heating equipment of claim 2, wherein the injection circuit branches from between the third heat exchanger and the fourth heat exchanger.

4. The heating equipment of claim 1, comprising:

a second expansion valve provided between the second heat exchanger and the third heat exchanger to be controlled by the controller.

5. The heating equipment of claim 4, wherein the third heat exchanger is a receiver provided with a function to store part of the refrigerant flowing from the second heat exchanger to the first heat exchanger, and exchanges heat between the refrigerant stored within the receiver and the refrigerant flowing from the first heat exchanger to the compressor.

6. The heating equipment of claim 5, wherein the second expansion valve decompresses the refrigerant flowing from the second heat exchanger to the receiver.

7. The heating equipment of claim 1, wherein the second heat exchanger is a condenser.

8. The heating equipment of claim 1, wherein the load side medium that exchanges heat with the refrigerant discharged from the compressor in the second heat exchanger is air.

9. The heating equipment of claim 1, wherein the load side medium that exchanges heat with the refrigerant discharged from the compressor in the second heat exchanger is water.

10. The heating equipment of claim 1, wherein the controller controls the injection expansion valve so that the refrigerant flowing in the injection circuit becomes a gas-liquid two phase state.

11. An outdoor unit of heating equipment which has a refrigerant circuit in which a first heat exchanger that makes a refrigerant absorb heat, a compressor that sucks the refrigerant that has passed the first heat exchanger and discharges the refrigerant to a second heat exchanger that is externally installed, and a first expansion valve that decompresses the refrigerant flowing from the second heat exchanger to the first heat exchanger, are connected so as to circulate the refrigerant, and the outdoor unit of heating equipment utilizes heat radiated from the second heat exchanger, the outdoor unit of heating equipment, comprising;

a third heat exchanger that provides heat of the refrigerant flowing from the second heat exchanger to the refrigerant flowing from the first heat exchanger toward the compressor;

an injection circuit that merges part of the refrigerant flowing from the second heat exchanger to the first heat exchanger with the refrigerant that is sucked by the compressor via the first heat exchanger to be compressed to an intermediate pressure;

an injection circuit expansion valve that is installed in the injection circuit and decompresses the refrigerant flowing in the injection circuit;

a fourth heat exchanger that is installed in the refrigerant circuit and the injection circuit and supplies heat of the refrigerant flowing from the second heat exchanger toward the first heat exchanger to the refrigerant flowing in the injection circuit; and a controller that controls an opening degree of the injection circuit expansion valve such that when a discharge temperature of the refrigerant detected by a first temperature sensor is higher than a predetermined target value, the opening degree is made to be larger so as to decrease an enthalpy of the refrigerant, and when the discharge temperature is lower than the predetermined target value, the opening degree is made to be smaller so as to increase the enthalpy of the refrigerant, thereby regulating a heating capacity of the second heat exchanger, wherein the target value of the discharge temperature is changeable by the controller according to operating conditions including a temperature detected by a second temperature sensor configured to detect a temperature of air to be sucked into a room unit and characteristics of the second heat exchanger.

12. The outdoor unit of heating equipment of claim 11, wherein the injection circuit branches from between the second heat exchanger and the first expansion valve.

13. The outdoor unit of heating equipment of claim 12, wherein the injection circuit branches from between the third heat exchanger and the fourth heat exchanger.

14. The outdoor unit of heating equipment of claim 11, comprising:

a second expansion valve provided between the second heat exchanger and the third heat exchanger to be controlled by the controller.

15. The outdoor unit of heating equipment of claim 14, wherein the third heat exchanger is a receiver having a function to store part of a refrigerant flowing from the second heat exchanger to the first heat exchanger, and exchanges heat between the refrigerant stored in the receiver and the refrigerant flowing from the first heat exchanger to the compressor.

16. The outdoor unit of heating equipment of claim 11, wherein the second expansion valve decompresses the refrigerant flowing from the second heat exchanger to the receiver.

17. The outdoor unit of heating equipment of claim 11, wherein the second heat exchanger is a condenser.

18. The outdoor unit of heating equipment of claim 11, wherein the load side medium that exchanges heat with the refrigerant discharged from the compressor in the second heat exchanger is air.

19. The outdoor unit of heating equipment of claim 11, wherein the load side medium that exchanges heat with the refrigerant discharged from the compressor in the second heat exchanger is water.

20. The outdoor unit of heating equipment of claim 11, wherein the controller controls the injection expansion valve so that the refrigerant flowing in the injection circuit becomes a gas-liquid two phase state.

* * * * *